US005570589A

United States Patent [19]

Petty

[11] Patent Number: 5,570,589

[45] Date of Patent: Nov. 5, 1996

[54] REFRIGERANT CIRCUIT ACCUMULATOR AND ASSOCIATED FABRICATION METHODS

[75] Inventor: Erwin H. Petty, Montgomery, Ala.

[73] Assignee: Rheem Manufacturing Company, New York, N.Y.

[21] Appl. No.: 379,732

[22] Filed: Jan. 27, 1995

[51] Int. Cl.[6] ..... F25B 43/02; F25B 43/00

[52] U.S. Cl. ..... 62/471; 62/503

[58] Field of Search ..... 62/503, 509, 471; 55/434

[56] References Cited

U.S. PATENT DOCUMENTS

| | | | |
|---|---|---|---|
| 3,344,506 | 10/1967 | Bottum et al. | 29/407 |
| 3,488,678 | 1/1970 | Wagner | 62/503 |
| 3,643,465 | 2/1972 | Bottum | 62/503 |
| 3,837,177 | 9/1974 | Rockwell et al. | 62/503 |
| 3,872,689 | 3/1975 | Bottum | 62/503 |
| 4,045,861 | 9/1977 | Zahid | 29/454 |
| 4,231,230 | 11/1980 | Gratzer et al. | 62/503 |
| 4,288,894 | 9/1981 | Jacobellis | 29/157 R |
| 4,458,505 | 7/1984 | Griffin | 62/503 |
| 4,611,750 | 9/1986 | Kish | 228/184 |
| 4,675,971 | 6/1987 | Masserang | 29/422 |
| 5,075,967 | 12/1991 | Bottum . | |
| 5,076,066 | 12/1991 | Bottum | 62/126 |
| 5,191,775 | 3/1993 | Shiina et al. | 62/503 |
| 5,282,370 | 2/1994 | Kiblawi et al. | 62/503 |

*Primary Examiner*—William E. Wayner
*Attorney, Agent, or Firm*—Konneker & Smith

[57] ABSTRACT

A refrigerant circuit suction accumulator has an inner copper U-tube with open inlet and outlet ends, a small oil inlet metering orifice formed in the closed tube end, and a threaded connection stud secured to the closed tube end. Formed on an inlet end portion of the U-tube is an integral deflector structure positioned between refrigerant outlet and inlet openings in the tube side wall. The U-tube legs extend through openings in a generally disc-shaped wire mesh filter element adjacent the closed tube end. The U-tube and filter element are disposed within a unitary tubular outer shell formed from a length of seamless copper tubing. In forming the assembly, one end of the outer copper tube is spun closed and a spaced pair of holes are formed therein. The U-tube is then inserted into the interior of the outer tube and the U-tube inlet and outlet ends are passed outwardly through and sealed within the outer tube end holes, the filter element being coaxially press-fitted within the outer tube, and the side wall refrigerant inlet and outlet openings in the U-tube being disposed within the interior of the outer tube. The remaining open outer tube end is then spun closed around and sealed to the connection stud.

13 Claims, 2 Drawing Sheets

REFRIGERANT CIRCUIT ACCUMULATOR AND ASSOCIATED FABRICATION METHODS

BACKGROUND OF THE INVENTION

The present invention generally relates to air conditioning apparatus and, in a preferred embodiment thereof, more particularly relates to refrigerant circuit accumulators and methods of fabricating them.

In a refrigerant circuit in which a compressor, condenser, expansion valve and evaporator are piped in series, an accumulator is typically interposed in the circuit between the outlet of the evaporator and the inlet of the compressor. The accumulator functions to trap oil and/or liquid refrigerant returning to the compressor, and also serves to meter the trapped oil and/or liquid refrigerant back to the compressor in a controlled manner.

The outer body or shell of a conventional suction accumulator is typically fabricated from a ferrous metal, such as steel, having a tubular body to the opposite ends of which closure caps are welded. The steel welding process can introduce weld splatter and scale onto the inner side of the accumulator body which tends to accelerate rusting of the accumulator. The steel welding process can also produce pin-hole leaks. Additionally, a steel accumulator structure connected to copper tube user joints can cause scrap and leaks for both the assembler and repairman, thereby accelerating early field failure at the accumulator structure.

Conventionally constructed accumulators typically require a relatively large number of individual components and a considerable number of welded or brazed joints which increase the possibility that the finished accumulator will eventually develop a leak. Additionally, due to their use of ferrous metal outer shells it is typically necessary to paint the exteriors of the finished accumulators to inhibit corrosion thereof.

From the foregoing it can readily be seen that it would be highly desirable to provide improved accumulator apparatus and associated fabrication methods which eliminate or at least substantially reduce the above-mentioned problems, limitations and disadvantages commonly associated with conventional refrigerant suction accumulators.

SUMMARY OF THE INVENTION

In carrying out principles of the present invention, in accordance with a preferred embodiment thereof, a refrigerant circuit accumulator is formed from only four parts—(1) a inner metal U-tube structure, preferably formed from a length of copper tubing; (2) a unitary, tubular outer shell, also preferably formed from a length of copper tubing; (3) a connection stud; and (4) a metal mesh filter element.

The copper inner U-tube structure has first and second generally parallel leg portions with open refrigerant inlet and outlet ends respectively disposed thereon; a curved, closed end portion disposed opposite the open inlet and outlet ends and joining the first and second leg portions; an oil inlet metering orifice formed in the closed end portion; a side wall refrigerant inlet opening formed in the first leg portion inwardly adjacent the open refrigerant inlet end thereof; a refrigerant discharge opening disposed in the first leg portion between its open refrigerant inlet end and the refrigerant inlet opening; and deflector means carried on the first leg portion for separating the side wall refrigerant inlet opening and the refrigerant outlet opening, and for intercepting refrigerant exiting the refrigerant outlet opening and deflecting the exiting refrigerant laterally outwardly from the first leg portion.

The leg portions of the inner U-tube structure extend through holes in the metal mesh filter element, which is preferably disposed between the side wall refrigerant inlet opening and the oil inlet metering orifice. The connection stud is secured to the closed U-tube end portion and projects outwardly therefrom generally parallel to and away from the U-tube leg portions.

In forming the accumulator, one end of the outer copper shell is spun closed and has a spaced pair of holes formed therein. The U-tube, with the filter element thereon, is inserted, open ends first through the open end of the outer shell until the open leg portion ends of the U-tube extend through and outwardly beyond the closed outer shell end.

The outwardly projecting leg portion ends are suitable swaged for connection into a refrigerant piping circuit, and the leg portions are sealed within the closed outer shell end by brazing. The remaining open end of the outer shell is then inwardly deformed and closed against the connection stud which projects outwardly beyond the closed second end of the outer shell. The stud is then sealed, by brazing, at its juncture with the outer shell.

According to another feature of the invention, the filter element is generally disc-shaped and has a circular peripheral portion snugly engaged with the interior side surface of the outer shell in a manner such that the filter element generally divides the interior of the outer shell into two facing longitudinal segments.

According to a further feature of the invention, the deflector means include an inwardly deflected side wall section of the first leg portion of the inner U-tube which forms thereon the refrigerant outlet opening and an integral refrigerant discharge baffle extending between and separating the refrigerant outlet opening and the side wall refrigerant inlet opening and being operative to intercept refrigerant exiting the refrigerant outlet opening and deflect the exiting refrigerant laterally outwardly from the first leg portion of the inner U-tube.

DETAILED DESCRIPTION

Figure 1:
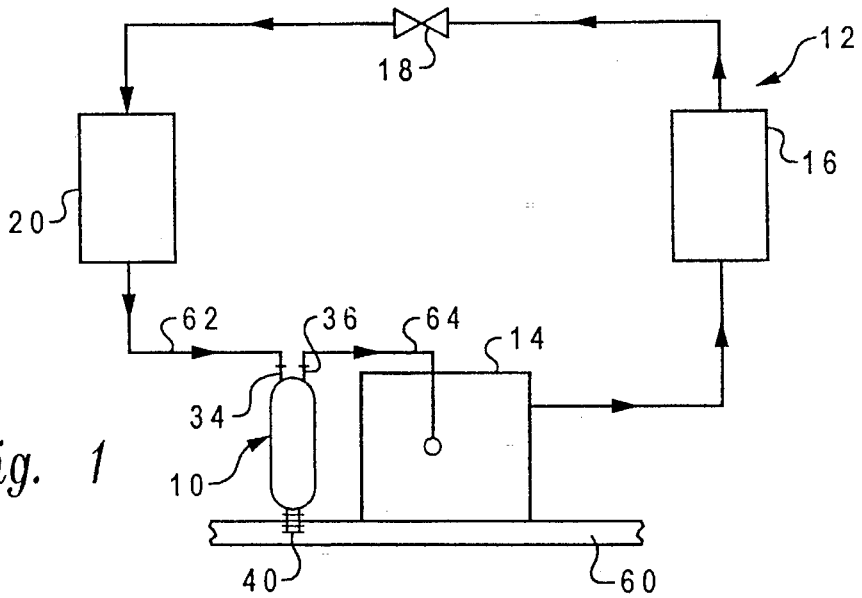
FIG. 1 is a schematic diagram of a representative refrigerant circuit having incorporated therein a uniquely fabricated accumulator structure embodying principles of the present invention.

Referring initially to FIG. 1, this invention provides a specially fabricated accumulator 10 incorporated in a refrigerant circuit 12 having the usual compressor 14, condenser 16, expansion valve 18 and evaporator 20 piped in series as shown. The accumulator 10 functions to trap oil and/or liquid refrigerant returning to the compressor 14, and also serves to meter the trapped oil and/or liquid refrigerant back to the compressor 14 in a controlled manner.

The outer body or shell of a conventional suction accumulator is typically fabricated from a ferrous metal, such as steel, having a tubular body to the opposite ends of which closure caps are welded. The steel welding process can introduce weld splatter and scale onto the inner side of the accumulator body which tends to accelerate rusting of the accumulator. The steel welding process can also undesirably produce pin-hole leaks. Additionally, a steel accumulator structure connected to copper tube user joints can cause scrap and leaks for both the assembler and repairman, thereby accelerating early field failure at the accumulator structure.

Conventionally constructed accumulators typically require a relatively large number of individual components and a considerable number of welded or brazed joints which increase the possibility that the finished accumulator will eventually develop a leak. Additionally, due to their use of ferrous metal outer shells it is typically necessary to paint the exteriors of the finished accumulators to inhibit corrosion thereof.

Figure 2:
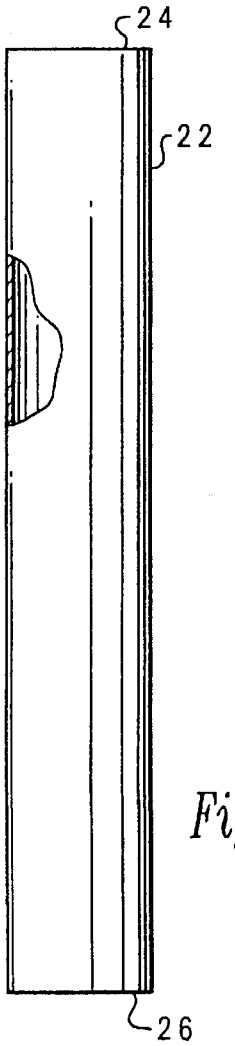
FIG. 2 is a partially cut away side elevational view of a length of seamless copper tubing used to form a unitary outer shell portion of the accumulator.
Figure 3:
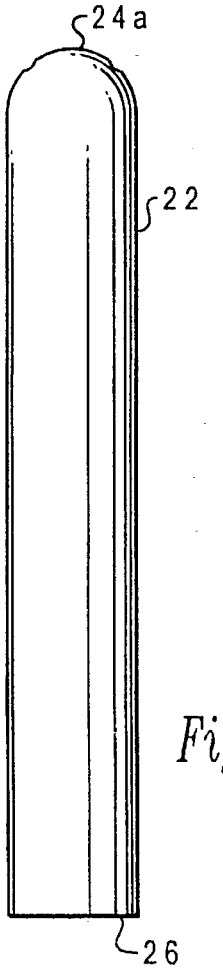
FIG. 3 is a side elevational view of a longitudinal portion of the tubing after the top end thereof has been spun closed.
Figure 4:
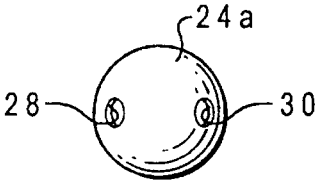
FIG. 4 is a top end view of the longitudinal tubing portion after a pair of holes have been formed in its spun-closed upper end.

The accumulator 10 of the present invention preferably utilizes a unitary copper housing, and is fabricated by a unique method that substantially eliminates these problems typically presented by steel accumulator structures. Referring now to FIG. 2, in fabricating the accumulator 10, a length of seamless copper tubing 22 is used to form the outer body of the accumulator 10, the upper and lower ends 24 and 26 of the tubing being open at the start of the fabrication process. As shown in FIGS. 3 and 4, the upper end of the tube 22 is then closed, as at 24*a*, using a spinning process. The spinning process is well known in the general metal forming art and is effected by holding the tube 22 stationary and forcing its end 24 into and against a rapidly spinning die of an appropriately curved shape. A combination of frictional heat and pressure deforms the upper tube end 24 to its closed, generally hemispherical shape. Alternatively, the die could be held stationary, and the tube 22 rotated about its longitudinal axis.

Figure 6:
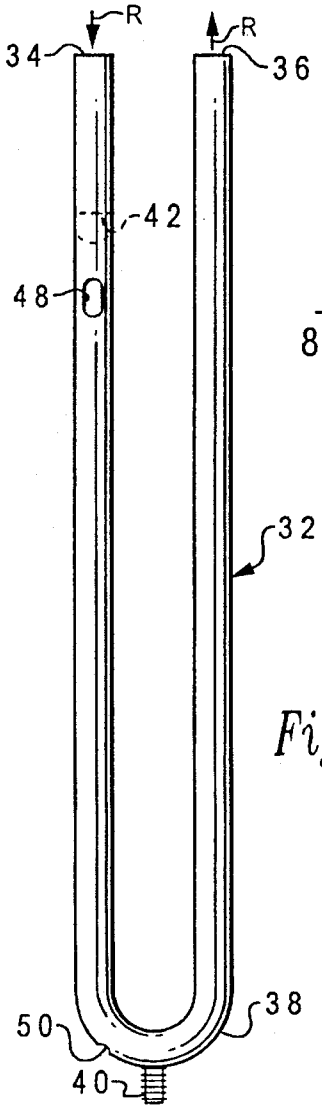
FIGS. 5 and 6 are side elevational views of an inner U-tube portion of the accumulator.

After the tube end 24 is spun-closed, two circular openings 28,30 are formed therein as illustrated in FIG. 4. Next, a smaller diameter metal tube, preferably a copper tube 32 is bent to a generally hairpin or U-shape as shown in FIGS. 5 and 6, the bent tube 32 having an open outer refrigerant inlet end 34, an open outer outlet end 36, and a curved, closed inner end portion 38 joining the leg portions of the U-tube 32 and from which an externally threaded connection stud, preferably a copper connection stud 40, outwardly projects, the stud 40 being suitably brazed to the closed tube end 38.

Figure 5:
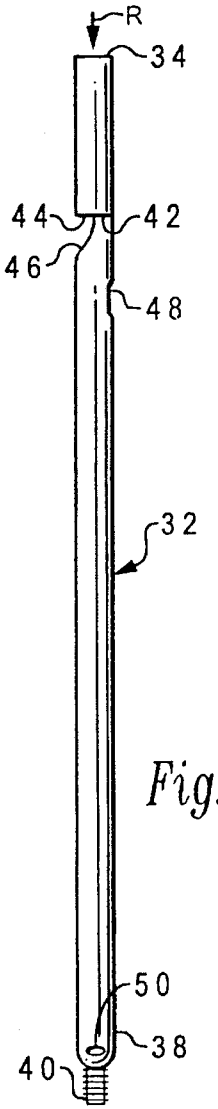

As best illustrated in FIG. 5, on the inlet end 34 of the tube 32 a side portion of the tube is blocked off, by an inwardly deflected side wall section 42 of the tube, and is opposite a downwardly facing opening 44 in the tube that faces a curved deflector portion 46 of the tube. Just below the deflector 46, on the opposite side of the inlet end portion 34 of the tube 32 is a side inlet opening 48. On the inlet side of the curved tube portion 38 a small diameter oil inlet metering orifice 50 is formed.

Figure 7:
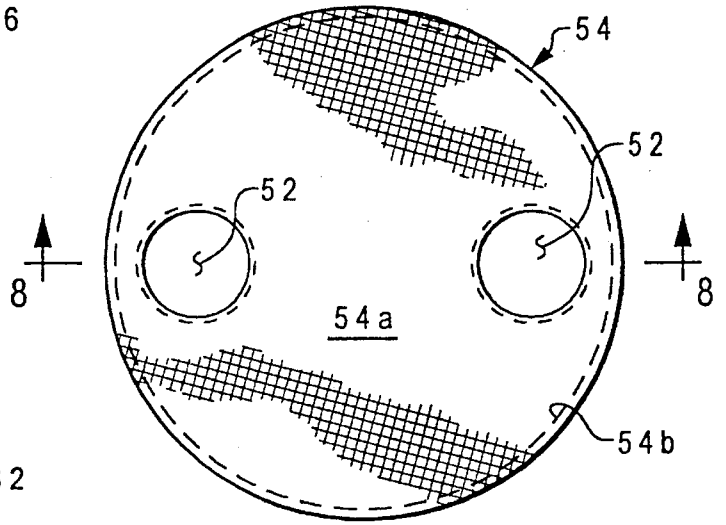
FIG. 7 is a top plan view of a wire mesh filter element incorporated in the accumulator.
Figure 8:
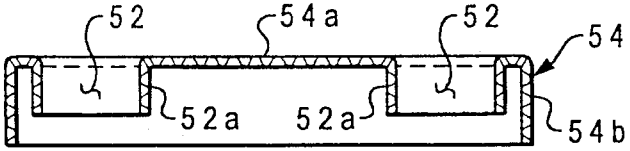
FIG. 8 is a cross-sectional view through the filter element taken along line 8—8 of FIG. 7.

After the tube 32 is constructed, its open ends 34,36 are pushed upwardly through openings 52 in a circular wire mesh filter element 54 (see FIGS. 7 and 8). Filter element 54 has a circular top side wall 54*a* with a depending peripheral flange portion 54*b*, and the openings 52 are disposed within tubular flange portions 52*a* depending from the underside of the top side wall 54*a* inwardly of the flange portion 54*b*. The bent tube 22 and filter 54 thereon are then inserted upwardly through the open tube end 26 (see FIG. 3) until the open ends 34,36 of the tube 32 extend outwardly through the openings 34,36 in the closed end 24*a* of the outer copper tube 22 (as illustrated in FIG. 9) and the filter 54 and the bent lower end portion 38 of the tube 32 are positioned as shown in the open lower end of the outer copper tube 22.

Figure 9:
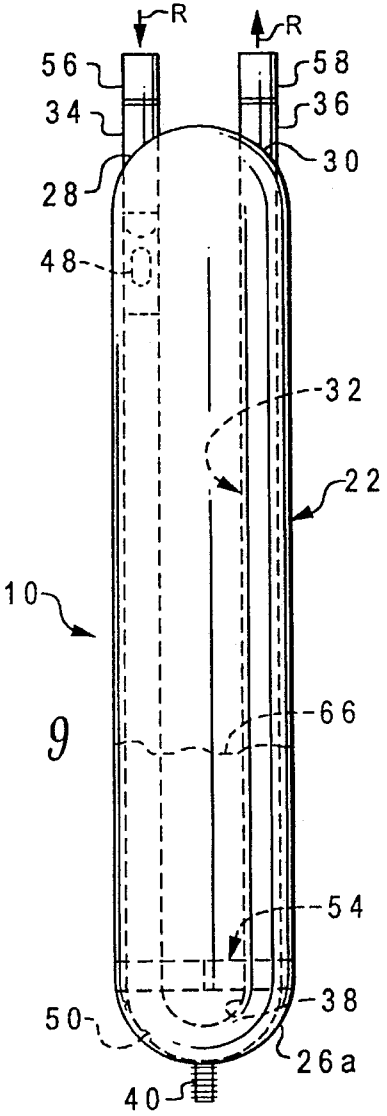
FIG. 9 is a side elevational view of the finished accumulator, with the interior structure thereof being shown in phantom.

The upper end openings 28,30 in the outer tube 22 are then appropriately sealed, by brazing, around the inlet and outlet ends 34,36 of the inner tube 32, and the outer ends of the tube 32 are swaged as at 56 and 58 in FIG. 9. The open lower end 26 of the outer tube 22 is then spun shut, as at 26*a*, around the threaded stud 40. The now closed lower end 26*a* of the outer tube 22 is then sealed, by brazing, around the stud 40. The finished accumulator 10 is then connected in the refrigeration circuit 12 (FIG. 1) by threading the stud 40 into (for example) a support rail 60 upon which the compressor 14 is mounted, connecting the accumulator inlet tube portion 34 to the indicated refrigerant line 62 exiting the evaporator 20, and connecting the accumulator outlet tube portion 36 to the indicated refrigerant line 64 leading to the inlet of the compressor 14.

Referring now to FIGS. 5, 6 and 9, during operation of the refrigerant circuit 12 refrigerant R is drawn, by suction of the compressor 14, into the inlet portion 34 of the inner pipe 32. The incoming refrigerant R (which comprises gaseous refrigerant, liquid refrigerant and oil) exits the tube opening 44, strikes the deflector wall 46, and is laterally deflected by the deflector wall laterally away from the inlet leg portion of the U-tube 32, thereby helping to separate the liquid refrigerant and oil from the gaseous refrigerant. The separated liquid refrigerant and oil 66 fall to the bottom of the outer tube 22 as shown in FIG. 9. At the same time, the suction of the compressor draws gaseous refrigerant into the pipe opening 48 and draws it into the compressor inlet via the pipe 64 (see FIG. 1). The screen 54 filters out scale and other particulate matter and prevents it from clogging the orifice opening 50. During operation Of the refrigerant circuit 12 the orifice 50 meters the inlet of oil into the inner pipe 32 for delivery therethrough to the compressor 14.

The accumulator 10 provides a variety of advantages over conventionally fabricated accumulators. For example, the accumulator 10 has only four parts—(1) the unitary outer tube or shell 22; (2) the inner U-tube 32; (3) the connection stud 40; and (4) the filter element 54. Additionally, there are only three external sealing joints—i.e., the three exterior braze joints at the stud 40 and the two open ends 34,36 of the U-tube 32.

Moreover, since there is no need to use a ferrous metal welding process in fabricating the accumulator, the problem of weld splatter within the outer accumulator shell is eliminated, with the copper-to-copper brazing joints substantially reducing the possibility of pin-hole leaks later developing. Furthermore, there is no need to paint the copper outer shell 22 to inhibit corrosion thereof. Additionally, the specially configured filter element 54, which divides the interior of the outer shell 22 into two facing longitudinal segments provides for substantially increased refrigerant filtering capacity within the outer shell of the accumulator.

The foregoing detailed description is to be clearly understood as being given by way of illustration and example only, the spirit and scope of the present invention being limited solely by the appended claims.

What is claimed is:

1. Refrigerant circuit accumulator apparatus comprising:

an inner metal U-tube structure having:

first and second generally parallel leg portions with open refrigerant inlet and outlet ends respectively disposed thereon, a curved, closed end portion disposed opposite said open inlet and outlet ends and joining said first and second leg portions, an oil inlet metering orifice formed in said curved, closed end portion of said U-tube, a side wall refrigerant inlet opening formed in said first leg portion inwardly adjacent said open refrigerant inlet end thereof, a refrigerant outlet opening formed in said first leg portion between said refrigerant inlet opening and said open refrigerant inlet end of said first leg portion, and deflector means carried on said first leg portion for separating said side wall refrigerant inlet opening and said refrigerant outlet opening, and for intercepting refrigerant exiting said refrigerant outlet opening and deflecting the exiting refrigerant laterally outwardly from said first leg portion;

a tubular, unitary outer copper metal shell longitudinally extending parallel to said first and second leg portions and enveloping said U-tube structure, said unitary outer copper shell having:

an inwardly deformed first closed end having a spaced pair of holes therein through which said open U-tube leg portion refrigerant inlet and outlet ends outwardly extend and are sealed within, and an inwardly deformed second closed end; and filter means, externally supported on said U-tube structure and disposed within said outer shell, for filtering refrigerant approaching said oil inlet metering orifice, said filter means being disposed between said oil inlet metering orifice and said side wall refrigerant inlet opening and generally dividing the interior of said outer shell into two facing longitudinal segments.

2. The refrigerant circuit accumulator apparatus of claim 1 wherein:

said inner metal U-tube structure and said unitary outer metal shell are formed from lengths of copper tubing.

3. The refrigerant circuit accumulator apparatus of claim 1 wherein:

said deflector means are integrally formed from a side wall section of said first leg portion of said inner metal U-tube structure.

4. Refrigerant circuit accumulator apparatus comprising:

an inner metal U-tube structure having:

first and second generally parallel leg portions with open refrigerant inlet and outlet ends respectively disposed thereon, a curved, closed end portion disposed opposite said open inlet and outlet ends and joining said first and second leg portions, an oil inlet metering orifice formed in said curved, closed end portion of said U-tube, a side wall refrigerant inlet opening formed in said first leg portion inwardly adjacent said open refrigerant inlet end thereof, and an inwardly deflected side wall portion of said first leg portion forming thereon a refrigerant outlet opening interposed between said side wall refrigerant inlet opening and said open refrigerant inlet end, and an integral refrigerant discharge baffle extending between and separating said refrigerant outlet opening and said side wall refrigerant inlet opening and operative to intercept refrigerant exiting said refrigerant outlet opening and deflect the exiting refrigerant laterally outwardly from said first leg portion;

a tubular, unitary outer metal shell longitudinally extending parallel to said first and second leg portions and enveloping said U-tube structure, said unitary outer shell having:

an inwardly deformed first closed end having a spaced pair of holes therein through which said open U-tube leg portion refrigerant inlet and outlet ends outwardly extend and are sealed within, and an inwardly deformed second closed end;

filter means, externally supported on said U-tube structure and disposed within said outer shell, for filtering refrigerant approaching said oil inlet metering orifice; and a connection stud having an end secured to a central portion of said curved, closed end portion and longitudinally extending outwardly therefrom, away from said first and second leg portions in a direction generally parallel to their lengths, said inwardly deformed second closed end of said outer shell having a hole therein through which said connection stud outwardly extends and is sealed within.

5. Refrigerant circuit accumulator apparatus comprising:

an inner metal U-tube structure having:

first and second generally parallel leg portions with open refrigerant inlet and outlet ends respectively disposed thereon, a curved, closed end portion disposed opposite said open inlet and outlet ends and joining said first and second leg portions, an oil inlet metering orifice formed in said curved, closed end portion of said U-tube, a side wall refrigerant inlet opening formed in said first leg portion inwardly adjacent said open refrigerant inlet end thereof, a refrigerant outlet opening formed in said first leg portion between said refrigerant inlet opening and said open refrigerant inlet end of said first leg portion, and deflector means carried on said first leg portion for separating said side wall refrigerant inlet opening and said refrigerant outlet opening, and for intercepting refrigerant exiting said refrigerant outlet opening and deflecting the exiting refrigerant laterally outwardly from said first leg portion;

a tubular, unitary outer copper metal shell longitudinally extending parallel to said first and second leg portions and enveloping said U-tube structure, said unitary outer copper shell having:

an inwardly deformed first closed end having a spaced pair of holes therein through which said open U-tube leg portion refrigerant inlet and outlet ends outwardly extend and are sealed within, and an inwardly deformed second closed end;

filter means, externally supported on said U-tube structure and disposed within said outer shell, for filtering refrigerant approaching said oil inlet metering orifice; and a connection stud having an end secured to a central portion of said curved, closed end portion and longitudinally extending outwardly therefrom, away from said first and second leg portions in a direction generally parallel to their lengths, said inwardly deformed second closed end of said outer shell having a hole therein through which said connection stud outwardly extends and is sealed within.

6. Refrigerant circuit accumulator apparatus comprising:

an inner metal U-tube structure having:

first and second generally parallel leg portions with open refrigerant inlet and outlet ends respectively disposed thereon, a curved, closed end portion disposed opposite said open inlet and outlet ends and joining said first and second leg portions, an oil inlet metering orifice formed in said curved, closed end portion of said U-tube, a side wall refrigerant inlet opening formed in said first leg portion inwardly adjacent said open refrigerant inlet end thereof, and an inwardly deflected side wall portion of said first leg portion forming thereon a refrigerant outlet opening interposed between said side wall refrigerant inlet opening and said open refrigerant inlet end, and an integral refrigerant discharge baffle extending between and separating said refrigerant outlet opening and said side wall refrigerant inlet opening and operative to intercept refrigerant exiting said refrigerant outlet opening and deflect the exiting refrigerant laterally outwardly from said first leg portion;

a tubular, unitary outer metal shell longitudinally extending parallel to said first and second leg portions and enveloping said U-tube structure, said unitary outer shell having:

an inwardly deformed first closed end having a spaced pair of holes therein through which said open U-tube leg portion refrigerant inlet and outlet ends outwardly extend and are sealed within, and an inwardly deformed second closed end; and filter means, externally supported on said U-tube structure and disposed within said outer shell, for filtering refrigerant approaching said oil inlet metering orifice, said filter means being disposed between said oil inlet metering orifice and said side wall refrigerant inlet opening and generally dividing the interior of said outer shell into two facing longitudinal segments.

7. The accumulator apparatus of claim 6 wherein:

said U-tube structure and said unitary outer shell are formed from lengths of copper tubing.

8. Refrigerant circuit accumulator apparatus comprising:

an inner metal U-tube structure having:

first and second generally parallel leg portions with open refrigerant inlet and outlet ends respectively disposed thereon, a curved, closed end portion disposed opposite said open inlet and outlet ends and joining said first and second leg portions, a connection stud having an end secured to a central portion of said curved, closed end portion and longitudinally extending outwardly therefrom, away from said first and second leg portions in a direction generally parallel to their lengths, an oil inlet metering orifice formed in said curved, closed end portion of said U-tube, a side wall refrigerant inlet opening formed in said first leg portion inwardly adjacent said open refrigerant inlet end thereof, and deflector means carried on said first leg portion for separating said side wall refrigerant inlet opening and said refrigerant outlet opening, and for intercepting refrigerant exiting said refrigerant outlet opening and deflecting the exiting refrigerant laterally outwardly from said first leg portion;

a tubular, unitary outer copper metal shell longitudinally extending parallel to said first and second leg portions and circumscribing said U-tube structure and said filter element, said unitary outer copper shell having:

an inwardly deformed first closed end having a spaced pair of holes therein through which said open U-tube leg portion refrigerant inlet and outlet ends outwardly extend and are sealed within, and an inwardly deformed second closed end with a hole therein through which said connection stud outwardly extends and is sealed within; and filter means, externally supported on said U-tube structure and disposed within said outer shell, for filtering refrigerant approaching said oil inlet metering orifice within said outer shell.

9. The refrigerant circuit accumulator apparatus of claim 8 wherein:

said U-tube structure and said unitary outer shell are formed from lengths of copper tubing.

10. Refrigerant circuit accumulator apparatus comprising:

an inner copper U-tube structure having:

first and second generally parallel leg portions with open refrigerant inlet and outlet ends respectively disposed thereon, a curved, closed end portion disposed opposite said open inlet and outlet ends and joining said first and second leg portions, a connection stud having an end secured to a central portion of said curved, closed end portion and longitudinally extending outwardly therefrom, away from said first and second leg portions in a direction generally parallel to their lengths, an oil inlet metering orifice formed in said curved, closed end portion of said U-tube, a side wall refrigerant inlet opening formed in said first leg portion inwardly adjacent said open refrigerant inlet end thereof, and an inwardly deflected side wall portion of said first leg portion forming thereon a refrigerant outlet opening interposed between said side wall refrigerant inlet opening and said open refrigerant inlet end, and an integral refrigerant discharge baffle extending between and separating said refrigerant outlet opening and said side wall refrigerant inlet opening and operative to intercept refrigerant exiting said refrigerant outlet opening and deflect the exiting refrigerant laterally outwardly from said first leg portion;

a generally disc-shaped metal wire mesh filter element having a spaced pair of holes extending axially therethrough, and a circular outer peripheral portion, said filter element being positioned between said oil inlet metering orifice and said side wall refrigerant inlet opening with said first and second U-tube leg portions being snugly received within said spaced pair of holes and said outer peripheral portion of said filter element outwardly circumscribing said first and second leg portions; and a tubular, unitary outer copper shell longitudinally extending parallel to said first and second leg portions and circumscribing said U-tube structure and said filter element, said unitary outer copper shell having:

an interior side surface snugly engaging said outer peripheral portion of said filter element, an inwardly deformed first closed end having a spaced pair of holes therein through which said open U-tube leg portion refrigerant inlet and outlet ends outwardly extend and are sealed within, and an inwardly deformed second closed end with a hole therein through which said connection stud outwardly extends and is sealed within.

11. The refrigerant circuit accumulator apparatus of claim 10 wherein:

said connection stud is externally threaded.

12. The refrigerant circuit accumulator apparatus of claim 11 wherein:

said connection stud is a copper connection stud, and said connection stud and said open refrigerant inlet and outlet ends of said first and second leg portion are sealed within their associated ends of said unitary outer shell with a brazing material.

13. The refrigerant circuit accumulator apparatus of claim 10 wherein said metal wire mesh filter element has:

a generally circular, disc-shaped body portion having a periphery and axially through which said filter element holes extend, a transverse peripheral flange section disposed around said peripheral, projecting toward said closed end of said U-tube structure, and defining said circular outer peripheral portion of said filter element, and a pair of tubular flanges bordering said filter element holes, closely circumscribing said first and second U-tube leg portions, and axially projecting toward said closed end of said U-tube structure.

* * * * *